US010704432B2

(12) United States Patent
Vincon et al.

(10) Patent No.: US 10,704,432 B2
(45) Date of Patent: Jul. 7, 2020

(54) DEVICE FOR ADJUSTING A CAMSHAFT OF AN INTERNAL COMBUSTION ENGINE

(71) Applicant: ETO Magnetic GmbH, Stockach (DE)

(72) Inventors: Peter Vincon, Stockach (DE); Timo Rigling, Radolfzell (DE); Maria Gruener, Owingen-Billafingen (DE)

(73) Assignee: ETO Magnetic GmbH, Stockach (DE)

( * ) Notice: Subject to any disclaimer, the term of this patent is extended or adjusted under 35 U.S.C. 154(b) by 149 days.

(21) Appl. No.: 15/322,210

(22) PCT Filed: Jun. 25, 2015

(86) PCT No.: PCT/EP2015/064427
§ 371 (c)(1),
(2) Date: Dec. 27, 2016

(87) PCT Pub. No.: WO2015/197777
PCT Pub. Date: Dec. 30, 2015

(65) Prior Publication Data

US 2018/0119585 A1 May 3, 2018

(30) Foreign Application Priority Data

Jun. 25, 2014 (DE) ..... 10 2014 108 927

(51) Int. Cl.
*F01L 13/00* (2006.01)
*F01L 1/14* (2006.01)

(52) U.S. Cl.
CPC ..... *F01L 13/0063* (2013.01); *F01L 1/14* (2013.01); *F01L 13/0036* (2013.01); *F01L 2013/0052* (2013.01); *F01L 2013/0084* (2013.01)

(58) Field of Classification Search
CPC ..... F01L 13/0036; F01L 13/0042; F01L 2013/0052; F01L 13/0063; F01L 2013/0078; F01L 2013/0084
(Continued)

(56) References Cited

U.S. PATENT DOCUMENTS

2012/0227697 A1* 9/2012 Grunberger ..... F01L 1/053 123/90.18

FOREIGN PATENT DOCUMENTS

CN 102678211 A 9/2012
DE 102008060166 A1 * 6/2010 ..... F01L 1/047
(Continued)

OTHER PUBLICATIONS

Machine Translation of DE102008060166A1, translated on May 2018.*

*Primary Examiner* — Mark A Laurenzi
*Assistant Examiner* — Loren C Edwards
(74) *Attorney, Agent, or Firm* — Bachman and Lapointe PC; George Coury

(57) ABSTRACT

A device for adjusting a camshaft of an internal combustion engine includes a lifting profile assembly rotationally fixed on an axially movable camshaft, and has a control groove having a depth that varies along a rotation direction, an actuator to cause axial movement by controlled engaging in the control groove, and an electromagnetically drivable tappet unit that cooperates with the control groove such that, when rotating, a reset or driver effect is exerted on the tappet unit, wherein the tappet unit has at least two independently drivable tappets, the control groove engages a first individual tappet, forms a radially peripheral wall along a peripheral groove side whereby a second individual tappet is positioned outside the control groove during rotation, and a ramp section cooperating with the second individual tappet
(Continued)

whereby the second individual tappet is reset or driven when the first individual tappet is reset or driven.

15 Claims, 8 Drawing Sheets

(58) Field of Classification Search
USPC ..... 123/90.18
See application file for complete search history.

(56) References Cited

FOREIGN PATENT DOCUMENTS

| | | | |
|---|---|---|---|
| DE | 102011001125 | A1 | 9/2012 |
| DE | 102012112482 | A1 | 6/2014 |

* cited by examiner

DEVICE FOR ADJUSTING A CAMSHAFT OF AN INTERNAL COMBUSTION ENGINE

BACKGROUND OF THE INVENTION

The present invention relates to a device for adjusting a camshaft of an internal combustion engine.

Such a generic device is known from DE 196 11 641 C1. This publication according to the prior art describes the background to the invention, including the structural realization of the camshaft, its mounting and its cooperation with the internal combustion engine, which is not entered into in detail in the present application.

In practice, this known device according to the introductory clause shows how actuating means in the form of an electromagnetically driven tappet unit through cooperation with a lifting profile can cause an axial adjustment of the camshaft, predetermined by the course of the control groove, for instance with the purpose of associating a cam to different cam tracks in a switchable manner.

In such devices, presupposed as being known and generic, typically a plurality of tappets (actuating pins) are used, so that, according to the axial movement position of the lifting profile assembly, respectively a pin standing suitably opposite the control groove can engage and can cause the respectively intended axial movement.

At the same time, now newer internal combustion engines with variable valve drive, controlled by means of a sliding cam system, require compact shifting gates (i.e. as narrow as possible along an axial direction) as lifting profile assembly. This lies for example in that a distance between the roller cam followers for actuation of the valves is limited owing to a small cylinder distance and accordingly an axial length of the sliding cam on the camshaft is likewise restricted.

In the practical realization, this then leads in the case of such shifting gates, embodied in a compact manner (in which for instance the groove course—observed in an unwound manner—is S- or respectively Z-shaped) to the fact that, depending on the switching position, an individual tappet of the tappet unit projects axially over an end or respectively an edge of the lifting profile assembly. Basically, this is not a problem, however for instance owing to a faulty actuation of the actuating means (i.e. the correct individual tappet currently standing opposite the control groove is not actuated), but rather a neighbouring one, outside the covering with the lifting profile assembly) a tappet advance is caused, without this tappet (on further rotation of the lifting profile assembly) being able to be reset again. Typically, the generic camshaft movement principle, presumed as pre-characterizing, is namely based in that in fact electromagnetically advanced tappets engage in a suitable manner into the control groove, but a resetting (i.e. a returning) of the respective tappet takes place, however, in that the control groove, designed with groove depth that varies, drives the respectively advanced tappet back into the starting position again.

With the tappet (potentially faultily actuated as described above), because also in the respective operating state lying outside the lifting profile assembly, such a resetting is then, however, no longer possible, and for lack of other resetting mechanisms this problem then leads to a blockage or respectively defective situation, which can led to engine damage.

A possible solution to this problem consists in providing tappet units for the actuating means, which tappet means can be brought automatically (for instance also again electromagnetically) from the driven advance position back into the reset starting position again. However, this requires not only considerable additional structural expenditure in the realization of the actuators used for the actuating means, also again, with already limited installation space, such a solution would again produce additional disadvantages with regard to space.

SUMMARY OF THE INVENTION

It is therefore an object of the present invention to configure a device for adjusting a camshaft in a compact manner and to improve it with regard to a reliable ability of the tappet unit to be reset and returned so that the latter, also without the necessity of an automatic resetting and merely by cooperating with the lifting profile assembly, can be reset into a starting position, even when the lifting profile assembly has a compact axial extent and permits switching states or respectively tappet positions in which—along the axial direction—an individual tappet of the tappet unit can be positioned axially outside the lifting profile assembly.

The problem is solved by the device for adjusting a camshaft as disclosed herein; advantageous further developments of the invention are also described herein.

In an advantageous manner according to the invention, according to a first invention variant, the two individual tappets of the tappet unit, provided neighbouring one another and preferably axially parallel to one another, make it possible that at least one of the individual tappets within each operating state is positioned above or respectively for cooperation with the control groove, so that the actuating of the first individual tappet (more precisely: the activating of the preferably associated electromagnetic actuator in order to cause the tappet advance) already produces a defined axial relationship between the tappet unit and the main profile assembly. If, for instance owing to the faulty actuation of the other of the individual tappets described in the introduction, or to an undefined rotatory position of the camshaft, the second individual tappet were to stand in an—unintentionally and ineffectively—extended (advanced) position, firstly through this structural realization the second individual tappet would be brought into an axial position in overlap with the lifting profile assembly (and outside the control groove), wherein the radially (or alternatively also axially) height-variable (namely raised) section formed according to the invention on the lifting profile assembly outside the control groove, or respectively the ramp section then on further rotation of the shaft (together with lifting profile system sitting thereon) via the ramp effect then causes the resetting or respectively driving of the second individual tappet. In other words, the realization of the first solution variant according to the invention with two individual tappets which are able to be actuated and driven independently of one another makes provision that even an unintentionally or respectively faultily advanced one of the individual tappets outside the control groove (which for the respectively other, interacting one of the individual tappets brings about the correct resetting) can be pushed back or respectively reset, so that a tappet unit situated correctly in the withdrawn starting position is then ready for further activations and switching processes without the risk of damage to the engine.

The second solution aspect according to the invention enables the same advantageous effects; here, however, the individual tappets are coupled mechanically to one another here so that a driving or respectively resetting of one of the individual tappets automatically causes an identical movement of the respectively other of the individual tappets, so that with this pairwise solution the radially height-variable section or respectively the ramp section of the first solution is not required. A typical realization of a coupling according to the invention for the realization of the second invention variant is shown by the applicant's DE 20 2008 008 142 U, whilst a possible structural realization for the separate, independent activation of the individual tappets is disclosed by way of example in the applicant's WO 2008/155119. With regard to these structural realizations, the disclosure contents of the named publications, are considered as included in the present application respectively belonging to the invention, and are incorporated herein by reference.

With regard to the first solution aspect, it is structurally particularly elegant to configure the vertical profile of the radially height-variable section (or respectively of the ramp section) so that the latter corresponds to the course of the groove depth. With individual tappets (again preferably) arranged and aligned parallel to one another, thus an aligned resetting movement is caused in corresponding resetting strokes. It is also preferred to configure the vertical profile (in an unwound projection of the circumference) at least linearly in certain sections, in order to provide in this respect for a regularity in the resetting- or respectively driver movement.

According to a further development, it is particularly elegant to configure the control groove so that the latter is delimited along its course (peripherally around the lifting profile assembly) on both sides by a radially projecting wall, wherein the latter, according to a further advantageous further development has a constant wall thickness, in order in this respect to combine simplified geometric conditions with simple producibility.

Within the scope of preferred further developments, it is also particularly preferred to radially dimension the peripheral surface region of the lifting profile assembly outside the control groove so that this surface region is not higher than a lowest groove depth, so that through the surface region outside the control groove an individual tappet taking up there reaches its maximum advance stroke, without an—even partial—resetting already taking place. On the other hand, it is preferred to arrange this radial vertical adjustment of the surface region not below the lowest groove depth of the control groove so that—taking usual tolerances into consideration—the individual tappet engaging on the surface region outside the lifting profile assembly, even taking into consideration acceleration- or other dynamic effects, does not become detached from the associated actuator- or respectively drive assembly.

Whilst the present invention is particularly suited for lifting profile assemblies (narrow in axial direction), which—in unwinding—have an S- or Z-shape control groove, the present invention is nevertheless not restricted to such groove courses or contours. Thus, for instance, it is conceivable within the scope of the invention to also provide along a circumferential or respectively unwinding direction of a lifting profile assembly two or more S- or respectively Z-shaped control grooves in succession, so that for instance, by means of a first S-shape, an axial movement along a first direction and then, according to a subsequent reversed S-shape, axial back movement along a rotation cycle (360°) can be arranged. Also, with regard to the advantageous narrow axial extent, advantageously and according to a further development, the axial extent of the lifting profile assembly is limited to maximally triple, preferably maximally double and further preferably maximally 1.5 times the distance of the individual tappets from one another (respectively measured by the distance of the respective tappet centre axes). However, this also concerns an advantageous further development, which does not limit the basic applicability of the invention also to other geometric conditions.

As a result, the invention therefore makes it possible in a surprisingly simple, structurally and mechanically elegant manner, to solve the dilemma of a multi-tappet camshaft adjustment with limited installation spaces, wherein even with unclear rotation positions and/or individual tappets activated in an undefined manner, also outside a practically associated control groove causing a mechanical resetting, an always reliable resetting into a non-advanced tappet starting position is made possible.

BRIEF DESCRIPTION OF THE DRAWINGS

Further advantages, features and details of the invention will emerge from the following description of preferred example embodiments and with the aid of the drawings; these show in FIG. 1(*a*) to FIG. 1(*c*) three diagrammatic illustrations of the configuration of a lifting profile assembly with control groove and tappet unit, associated diagrammatically therewith, of two individual tappets according to a first embodiment, wherein the partial figure (a) shows a side view with diagrammatically drawn groove course and positions of the first individual tappet in engagement along a rotation of the lifting profile assembly, in vertically unwound illustration, partial figure (b) a top view onto the groove course in unwound illustration with three possible movement positions of the pair of individual tappets, and partial figure (c) an unwound longitudinal sectional view through the device according to partial figure (b).

DETAILED DESCRIPTION

Figure 1:
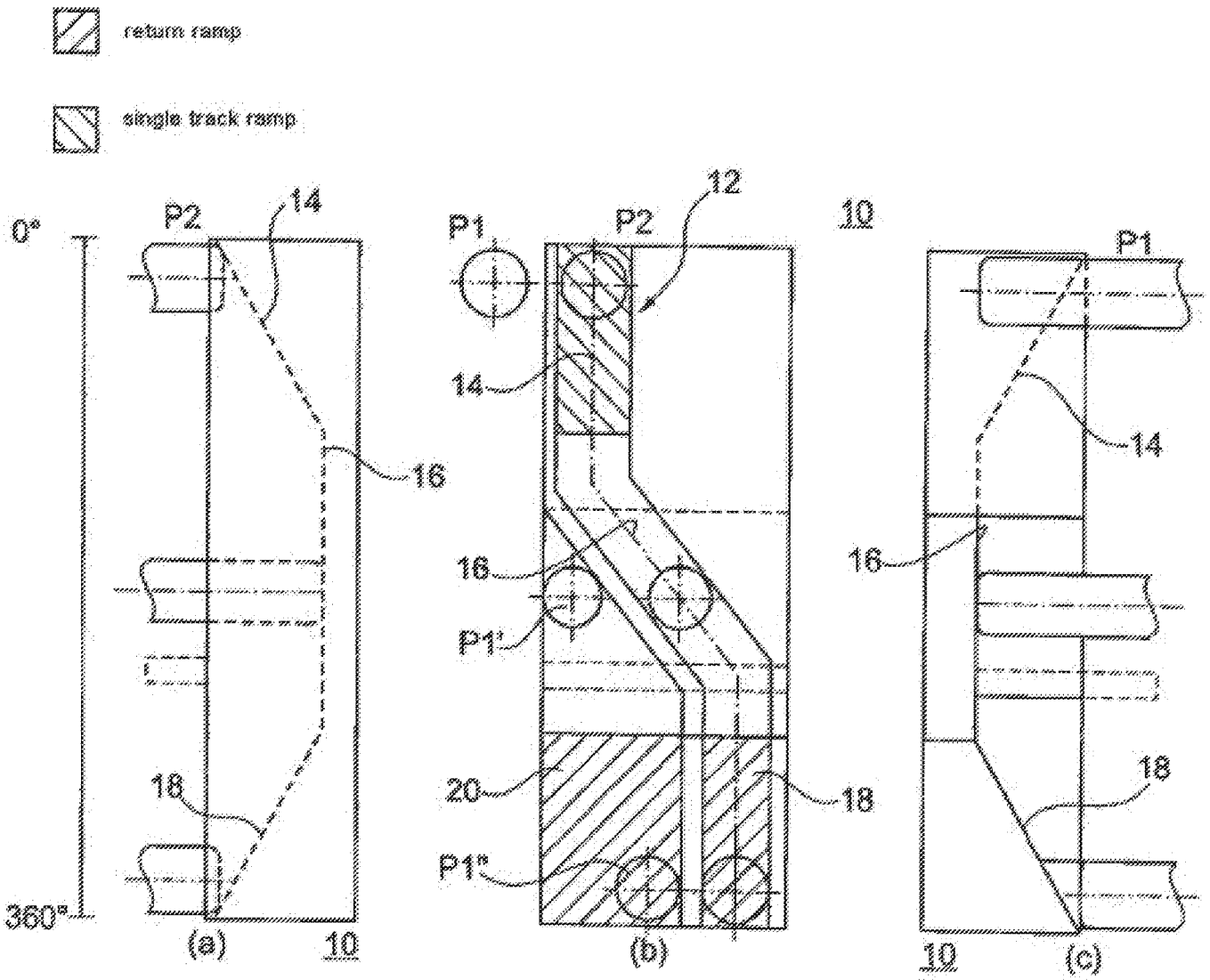

FIG. 1 illustrates firstly in the unwound top view of the partial figure (b), how on a peripheral outer face of a lifting profile assembly 10 (shifting gate) a control groove 12 is formed, which has along the unwound circumference (0° to 360°) the shown S- or respectively Z-shaped groove course. This control groove 12 has the altered groove depth course which can be seen in the partial figure (a) of FIG. 1 (dashed line 14), between a maximum groove depth 16 and a groove depth 18, reduced in a ramp-like manner, which, again according to partial figure (a), illustrates the principle of the mechanical resetting of the shown (first) individual tappet P2:

Through rotation of the shifting gate and therefore of the control groove 12, at the position of smallest groove depth the engaging individual tappet is brought back from its originally extended position (in the region of the greatest groove depth 16) into its pushed back, non-expanded position.

Additionally, the first example embodiment of FIG. 1, shown through the hatched region 20 outside the control groove, has a ramp section which has a vertical profile, corresponding to the control groove (more precisely: a linearly rising course). The purpose of this ramp section is to bring the (potentially unnecessarily or respectively incorrectly extended) second individual tappet P1 back into its pushed back initial position again. This takes place in that from the position of FIG. 1(*b*) at the top (i.e. the individual tappet P1 stands axially laterally and therefore outside the lifting profile assembly), firstly through the engagement effect of the first individual tappet P2 the arrangement is moved axially until P1 also stands above the lifting profile assembly, nevertheless outside the control groove; this is illustrated by the position P1' in the centre of the unwinding illustration of FIG. 1(*b*). On further rotation of the lifting profile assembly, the rising ramp region 20 is then in action, so that in the lower position P1" the ramp 20 has reset the individual tappet P1 (in a parallel manner, this has taken place through the groove 14, running with the same vertical profile, for the tappet P2), without, however, P1 having being situated in engagement with the control groove. This leads to the fact that at the end of the actuation (in so far as in the unwinding illustrated by the lower region of the part figures in FIG. 1) both individual tappets are situated respectively in their pushed back initial position and can be activated accordingly for renewed operating processes.

Figure 2:
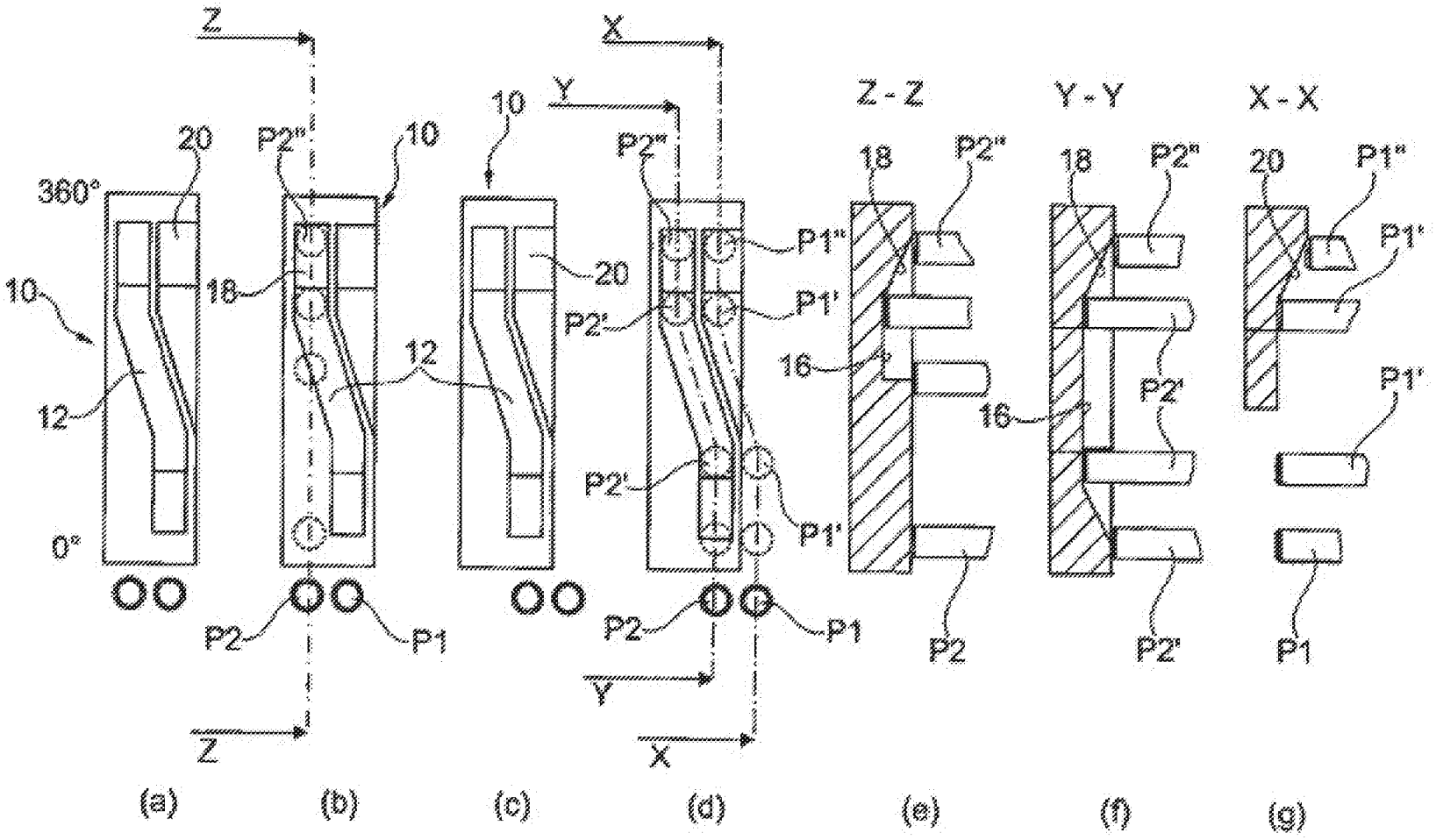
FIG. 2(*a*) to FIG. 2(*g*) diagrammatic illustrations and groove longitudinal section illustrations to the first example embodiment of FIG. 1, wherein the position 2 shown in FIG. 2 with associated sections corresponds to the illustrations of FIG. 1 and the position 1 of FIG. 2 illustrates an alternative relative position of the individual tappets to the lifting profile assembly.

The illustration of FIG. 1 corresponds furthermore to the illustration of the position 2 in FIG. 2 according to the partial illustrations (c) or respectively (d) and associated groove profile courses along the sections Y-Y and X-X (wherein FIG. 2, with respect to FIG. 1, in the figure plane shows a movement direction 0° to 360° in upward direction, inversely to the illustration of FIG. 1).

In addition, the alternative alignment of the individual tappets P1, P2, marked as position 1 in FIG. 2, relative to the assembly 10, shows that here also for instance an actuation of the tappet P2 (usually not expedient, but possible for instance in the case of an error) would not lead to a disturbance or to a damage of the arrangement: If namely a tappet actuation of P2, positioned outside the groove 12 in FIG. 2(*b*), were to lower the tappet P2, the latter arrives merely onto the outer surface of the lifting profile assembly 10 (section Z-Z) and slides there along the further rotation, until the groove 12 is reached. Then as soon as P2 then engages into the groove 12, it indeed reaches the groove base 16, however on further rotation it is immediately pushed out along the ramp 18 again, so that with a complete 360° circulation the original state is produced again without damage. Thereby, the additional illustration of position 1 also illustrates that the shown arrangement is failsafe or respectively resistant to breakdown in this respect.

Figure 3:
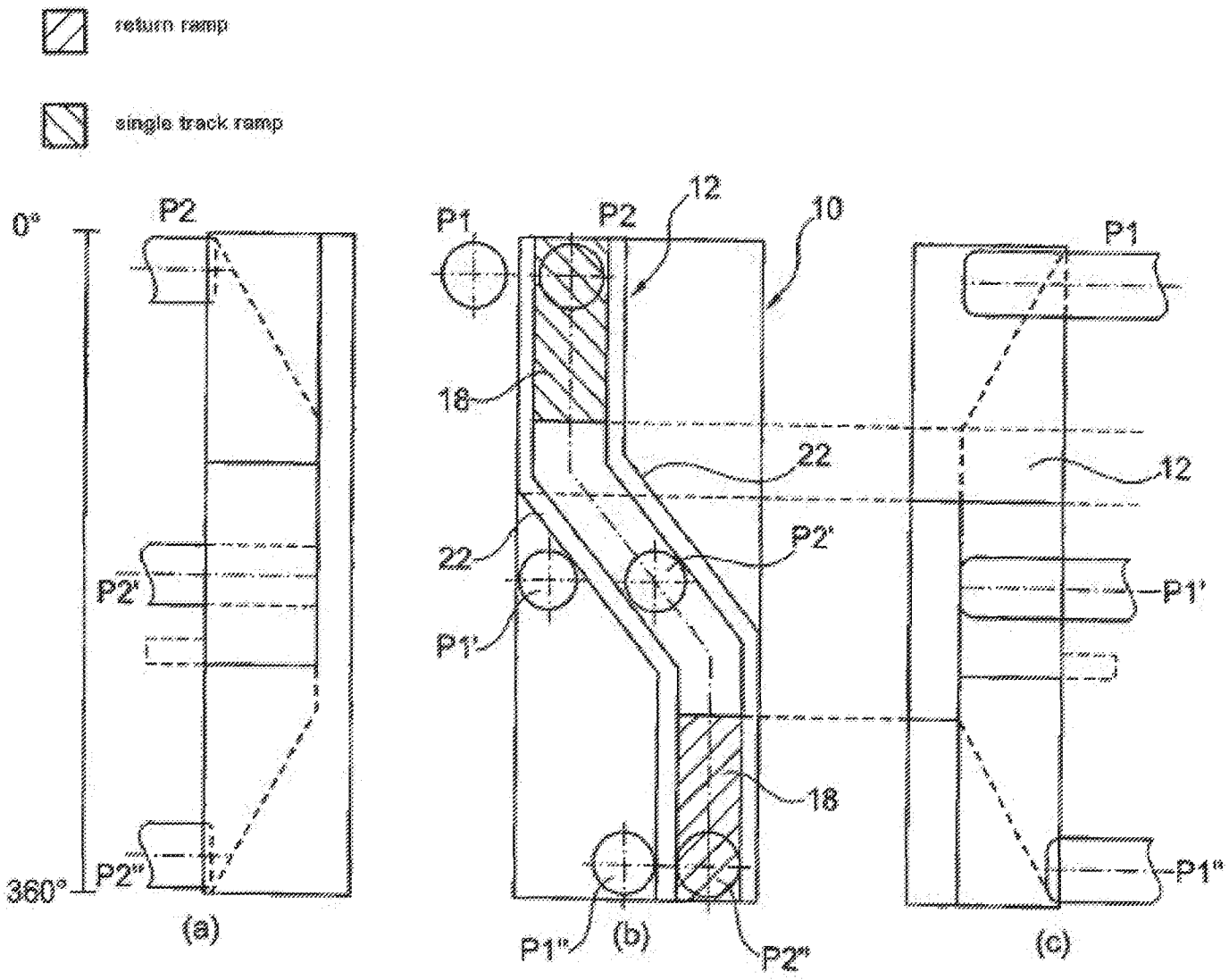
FIG. 3(*a*) to FIG. 3(*c*) analogous to the illustrations of FIG. 1 shows a second example embodiment, varied with respect to the first example embodiment of FIG. 1 or respectively FIG. 2, in which the pair of the individual tappets are coupled to one another.
Figure 4:
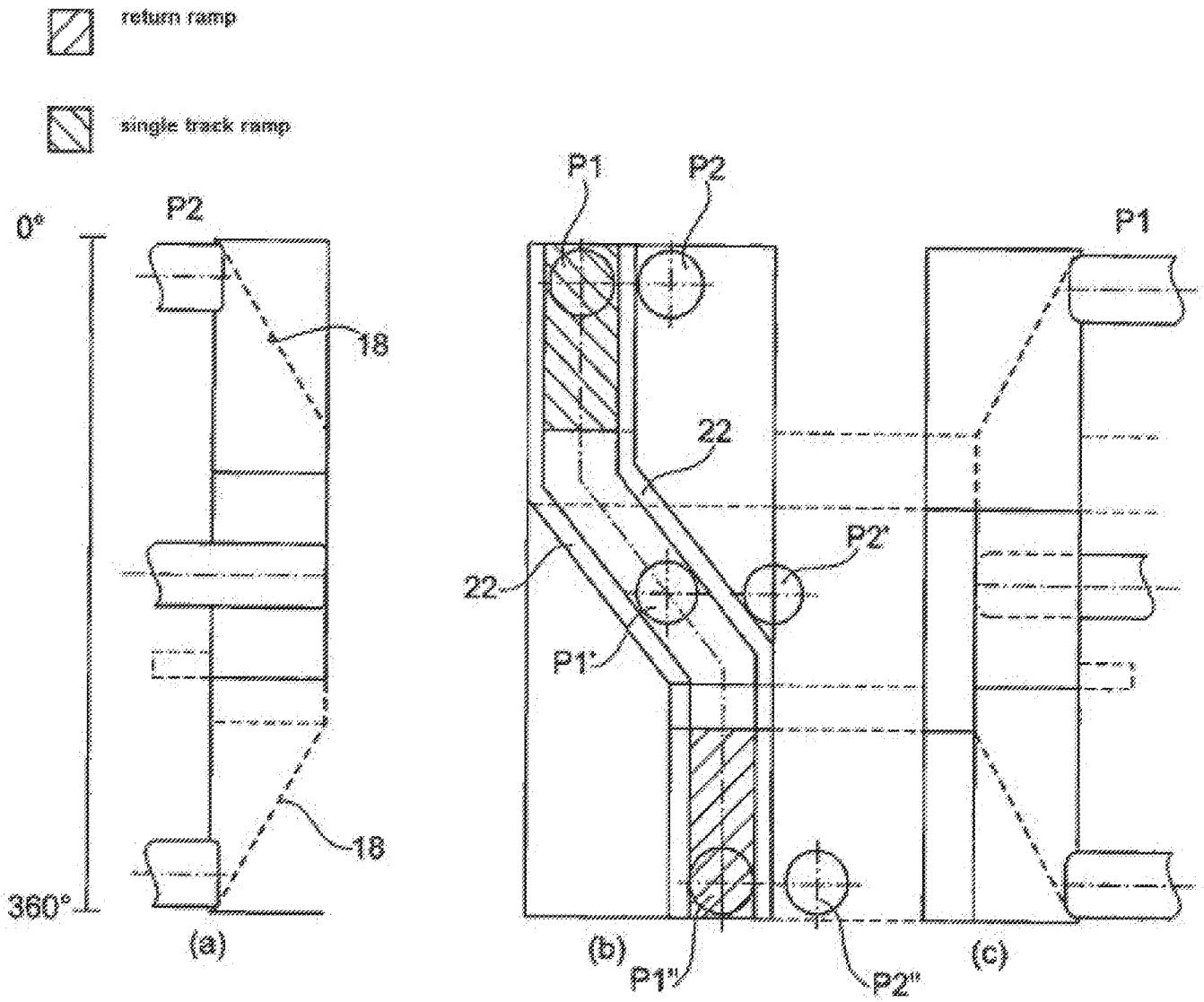
FIG. 4(*a*) to FIG. 4(*c*) illustrates again with respect to the second example embodiment of FIG. 2, an axially altered switching position, with respect to the switching state (switching position) of FIG. 2, of the (coupled) pair of individual tappets.
Figure 5:
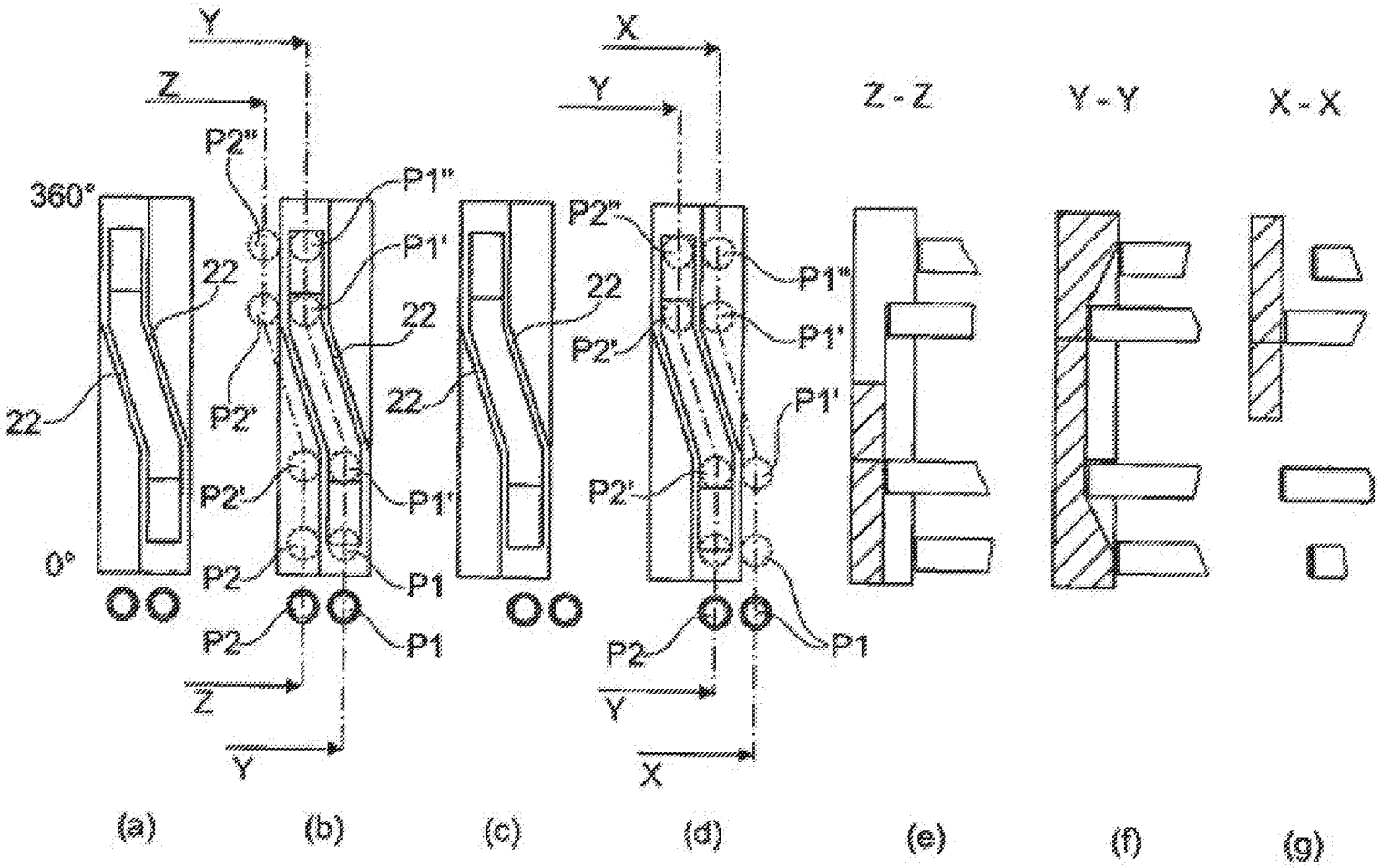
FIG. 5(*a*) to FIG. 5(*g*) illustrations with respect to the second example embodiment of FIG. 3 or respectively FIG. 4, wherein the position 1 shown in FIG. 5 corresponds to FIG. 4 and the position 2 shown in FIG. 5 corresponds to FIG. 3, with respectively associated section positions along the groove courses and adjacent thereto.
Figure 7:
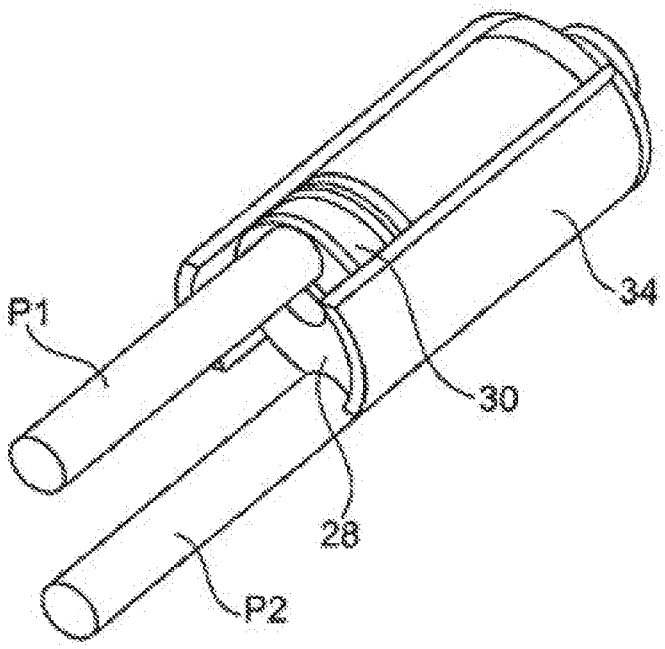
FIG. 7: a perspective illustration of actuating means with a tappet unit.

In the analogous visual preparation and presentation, FIG. 3 to 5 show the second solution aspect of the invention by means of a second example embodiment of the invention. The same reference numbers illustrate identical components or respectively components having the same effect, wherein the example embodiment of FIG. 3 to 5 differs from the example embodiment of FIG. 1, 2 in that in FIG. 3-5 the pair of individual tappets P1, P2 is coupled mechanically to one another, whereas in the first example embodiment these are able to be driven independently of each other. FIG. 7, in so far as a cutout of DE 20 2008 008 142 U already discussed and included above, illustrates a possible structural realization of such a coupling. Both tappets P1, P2 sit on a driving plate 28 and are held there by means of the force of a permanent magnet 30. The driving plate 28 and permanent magnet 30 are, in turn, axially movable armature components as a reaction to the energizing of a coil unit, which carry out an axial stroke movement in an otherwise known manner; reference number 34 shows an (again otherwise known) magnetically conductive bracket section for producing a magnetic flow circuit bringing about the drive. The arrangement which is thus applied by way of example according to FIG. 7 would bring about a simultaneous movement of both individual tappets P1, P2 accordingly and as the basis for the operating behaviour of FIG. 3-5.

In practical realization, the second example embodiment of FIG. 3-5 differs from the first example embodiment in that the lifting profile assembly (shifting gate) 10 outside the control groove 12, which itself is profiled like the control groove 12 of the first example embodiment, does not have a ramp, but rather has a radial (cylindrical) outer face, the height of which corresponds to the lowest groove depth 16. Here, also, however, through the mechanical coupling of the individual tappets P1, P2, described by way of example in the example of FIG. 7, in the course of the rotation and in particular in the rising groove course 18 up to the smallest groove depth of the individual tappet P2 thereby actuated in a resetting manner would drive the individual tappet P1 running outside the groove and likewise also return it into the pushed-in resetting position.

Here, a wall section 22, which can be seen in FIGS. 3 to 5, delimiting the groove 12 laterally respectively, ensures that beyond the guidance of the tappet running in the groove, a tappet (e.g. P1 in FIG. 3 or respectively P2 in FIG. 4) standing outside the groove, can not slide into the groove for instance unintentionally, when an unintended or respectively faulty drive of these tappets takes place. With regard to FIG. 5, the position 1 shown there (together with part figures (a) and (b) and the sections Z-Z and Y-Y) corresponds to the illustrations of FIG. 4, and the position 2 shown in FIG. 5 together with the part figures (c) and (d) corresponds with section Y-Y and X-X of FIG. 3. The sectional views, in so far as simplifying, do not contain any detailed illustration of the wall 22 describing the groove on both sides.

Figure 6:
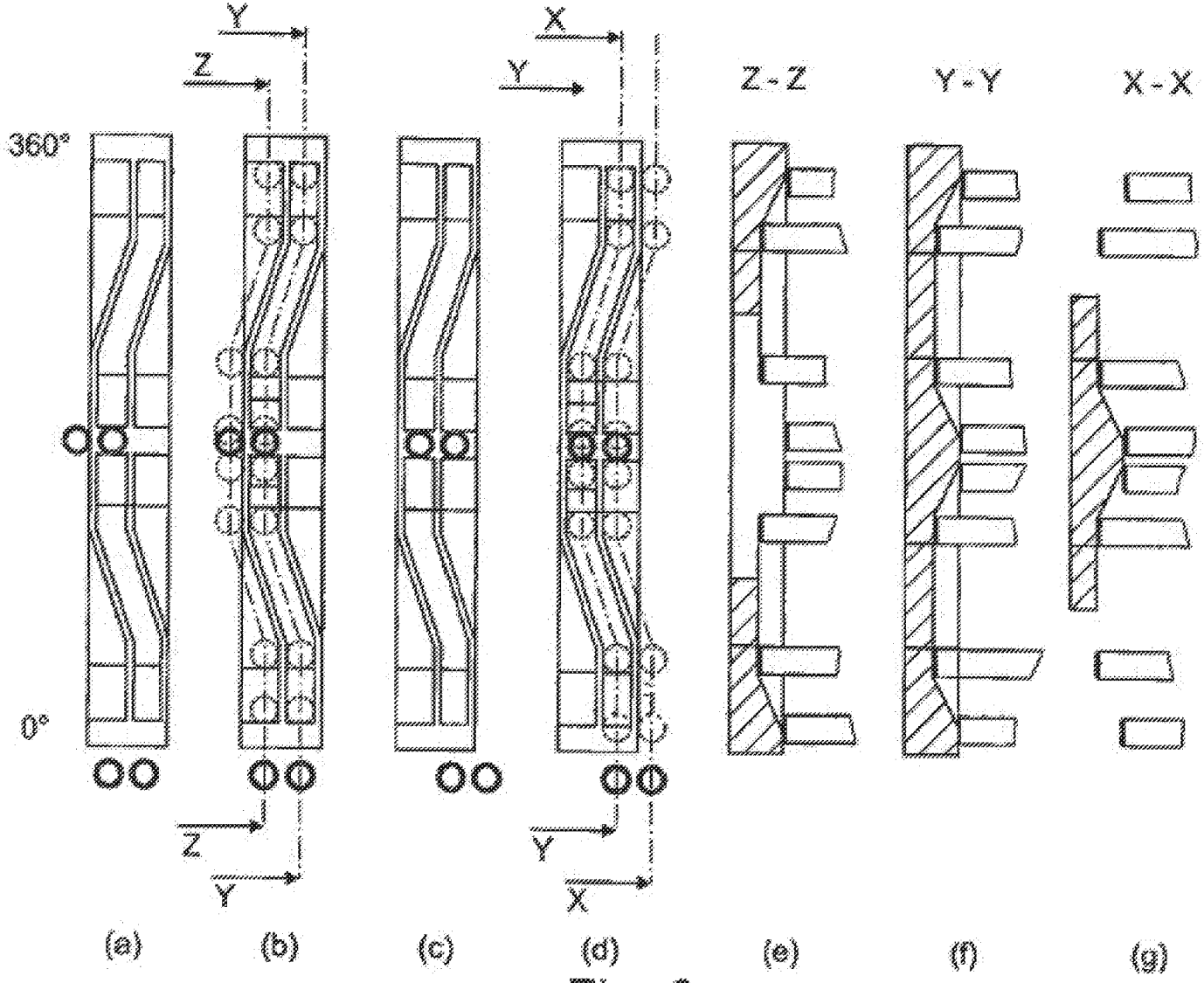
FIG. 6(*a*) to FIG. 6(*g*) illustrations with respect to a third example embodiment, which additionally varies the second example embodiment of FIGS. 3 to 5, wherein a simple Z-course, shown in the unwinding of FIGS. 3 to 5, is additionally supplemented in FIG. 6 by a further, axially opposed Z-course along the unwound circumference.

In addition, the illustration of FIG. 6 shows as third example embodiment a further development of the second example embodiment and follows the structure of FIG. 5; in contrast to FIG. 5, the groove courses 12 along the circumference contain 0° to 360° but not a simple S- or respectively Z-shaped course in unwinding (as shown for instance in FIGS. 5(*a*) to 5(*d*)), rather, along the circumference a double S- or respectively Z-shape is formed, so that the course in the example embodiment of FIG. 6 carries out the movement of the second example embodiment (FIG. 3 to FIG. 5) already within a half revolution 0° to 180°, whilst the second circumferential half 180° to 360° describes a reversed S- or respectively Z-shaped course. Thereby the variant of FIG. 6 enables a more complex, in this respect forward and back setting of the movement behaviour beyond the preceding example embodiments.

Figure 8:
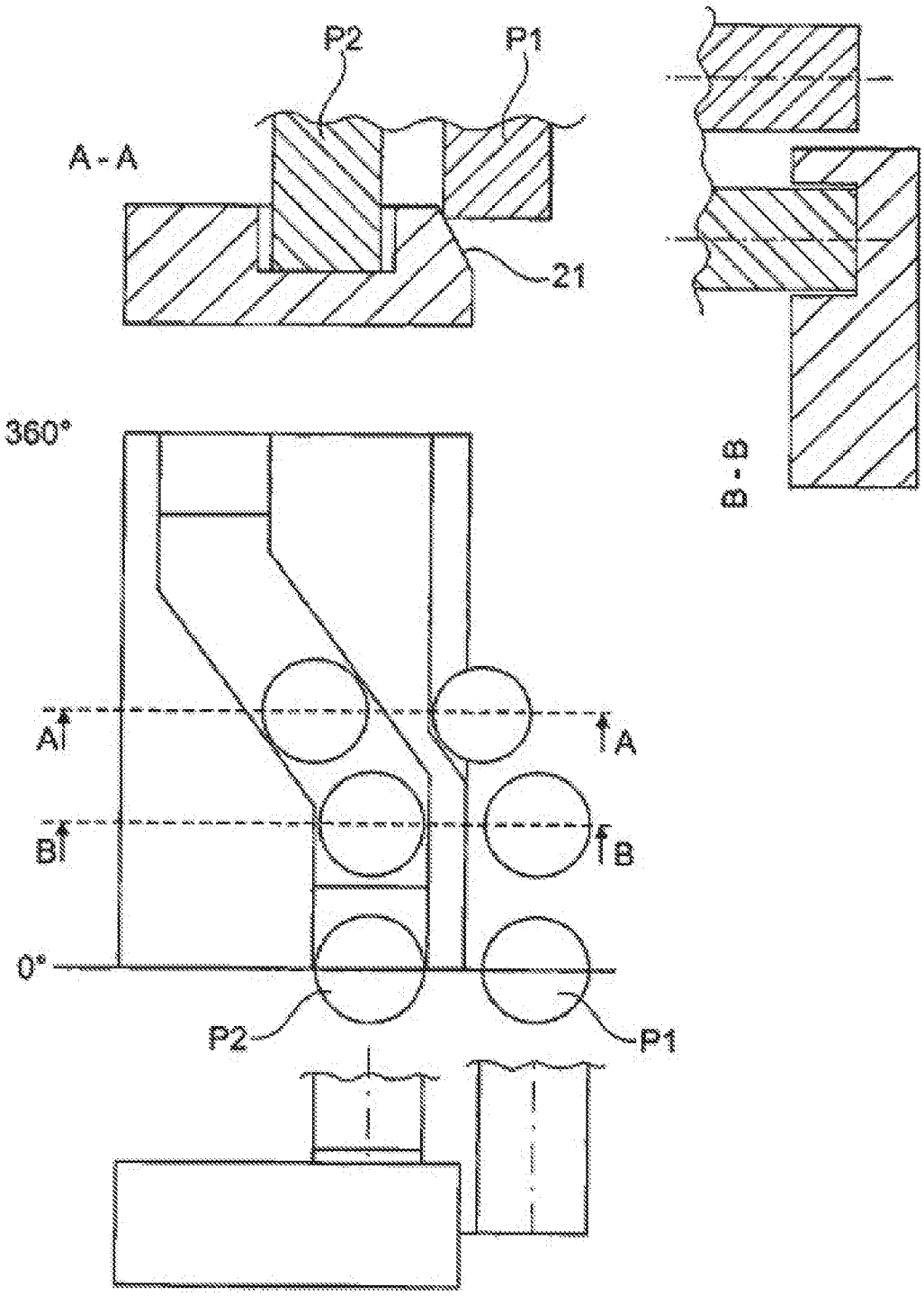
FIG. 8 diagrammatic illustrations of an alternative configuration of the ramp section 20 for the first example embodiment of FIGS. 1, 2 outside the control groove 12.

Finally, the example embodiment of FIG. 8 shows as additional, generic formation and further development of the first example embodiment of FIG. 1, 2, a possibility of constructing the ramp 20, formed outside the control groove, not as a face rising along the circumferential direction, but rather as a bevel 21 running transversely to the circumferential direction (and thereby in axial direction), as FIG. 8 illustrates in the sectional view A-A for the central top view. It becomes clear that with a sliding of the tappet P1, lying outside the groove here, along this ramp 21, which is bevelled here axially, the driving- or respectively movement behaviour equivalent to the example embodiment of FIG. 1, 2 can be achieved.

The present invention is not restricted to the example embodiments which are shown, but rather is also suited for any desired other variants and configurations of the camshaft adjustment device. Also, any desired combinations and sub-combinations of the features which can be seen from the present disclosure are to be deemed as belonging to the present invention and as being disclosed accordingly.

The invention claimed is:

1. A device for adjusting an axially movably mounted camshaft of an internal combustion engine, comprising a lifting profile assembly (10) which is provided in a rotationally fixed manner on or at the camshaft, wherein the lifting profile assembly (10) forms a control groove (12), having a groove depth that varies along a direction of rotation, and comprising actuating means (FIG. 4) which are designed to cause an axial movement by controlled engaging in the control groove, and which have an electromagnetically drivable tappet unit (P1, P2), wherein the tappet unit cooperates with the control groove such that, when rotating, the control groove can exert a reset or driver effect on the tappet unit in a predetermined groove section, wherein the tappet unit has at least two neighboring individual tappets (P1, P2), said tappets being independently drivable, the control groove, designed to engage using a first of the individual tappets (P2), forms a radially peripheral wall at least along a peripheral groove side such that a neighboring second of the individual tappets (P1) is positioned outside the control groove during rotation, and the lifting profile assembly is provided with a radially height-variable ramp section (20) positioned axially laterally outside the control groove for cooperating with the second individual tappet, such that a resetting and/or driving of the second individual tappet (P1) is caused when the first individual tappet (P2) is reset or driven against a tappet drive direction using the control groove, wherein the radially height-variable ramp section (20) has a radial vertical profile which runs parallel to a course of the groove depth.

2. The device according to claim 1, wherein the radial vertical profile has a course which is linear at least in certain sections.

3. The device according to claim 1, wherein a plane defined by the first and the second individual tappets runs parallel to the longitudinal axis of the camshaft.

4. The device according to claim 1, wherein the control groove has two sides, and the control groove is delimited on both sides and peripherally by a radially projecting wall.

5. The device according to claim 4, wherein the radially projecting wall has a peripherally constant wall thickness.

6. The device according to claim 1, wherein the control groove, observed unwound over the circumference of the lifting profile assembly, is formed by a simple or double S- or Z-shaped control groove.

7. The device according to claim 1, wherein an axial extent of the lifting profile assembly is not greater than three times, preferably twice, further preferably 1.5 times, a tappet distance of the first and of the second individual tappet, parallel thereto, in relation to the respective tappet center axes.

8. The device according to claim 7, wherein the axial extent of the lifting profile assembly is not greater than twice the tappet distance of the first and of the second individual tappet, parallel thereto, in relation to the respective tappet center axes.

9. The device according to claim 7, wherein the axial extent of the lifting profile assembly is not greater than 1.5 times the tappet distance of the first and of the second individual tappet, parallel thereto, in relation to the respective tappet center axes.

10. The device according to claim 1, wherein the at least two individual tappets are axially parallel.

11. A device for adjusting an axially movably mounted camshaft of an internal combustion engine, comprising a lifting profile assembly (10) which is provided in a rotationally fixed manner on or at the camshaft, wherein the lifting profile assembly (10) forms a control groove (12), having a groove depth that varies along a direction of rotation, and comprising actuating means which are designed to cause an axial movement by controlled engaging in the control groove, and which have an electromagnetically drivable tappet unit (P1, P2), wherein the tappet unit cooperates with the control groove such that, when rotating, the control groove can exert a reset or driver effect on the tappet unit in a predetermined groove section, wherein the tappet unit has at least two neighboring individual tappets (P1, P2) configured so as to be drivable and resettable jointly with one another so that a drive and reset effect on a first of the individual tappets brings about a driving or respectively resetting of a second of the individual tappets, and the control groove designed for engaging the first individual tappet forms at least along a circumferential groove side a radially peripheral wall so that the neighboring second individual tappet lies outside the control groove when rotating, wherein a peripheral surface region of the lifting profile assembly axially laterally outside the control groove has a radial height which is not higher than a greatest groove depth (16).

12. The device according to claim 11, wherein the first and the second individual tappets sit magnetically, adhering at or on a shared drive surface of an electromagnetic actuator unit of the actuating means.

13. The device according to claim 12, wherein the first and the second individual tappets sit permanent-magnetically adhering at or on a shared drive surface of the electromagnetic actuator unit of the actuating means.

14. The device according to claim 11, wherein the radial height corresponds to the greatest groove depth.

15. The device according to claim 11, wherein the at least two individual tappets are axially parallel.

* * * * *